US005398750A

United States Patent [19]

Crepeau et al.

[11] Patent Number: 5,398,750

[45] Date of Patent: Mar. 21, 1995

[54] QUIESCENT-FLOW METAL POURER

[75] Inventors: Paul N. Crepeau, Saginaw; Gordon A. Tooley, Midland; A. Dean Vander Jagt, Essexville, all of Mich.

[73] Assignee: General Motors Corporation, Detroit, Mich.

[21] Appl. No.: 235,025

[22] Filed: Apr. 28, 1994

[51] Int. Cl.[6] ..... B22D 39/00; B22D 46/00

[52] U.S. Cl. ..... 164/154.2; 164/259; 164/323; 164/337

[58] Field of Search ..... 164/323, 337, 259, 154.2

[56] References Cited

U.S. PATENT DOCUMENTS

| | | | |
|---|---|---|---|
| 2,039,738 | 5/1936 | Pugh | 164/337 |
| 2,054,921 | 9/1936 | Betterton | 164/259 X |
| 2,522,031 | 9/1950 | Gavin, Sr. | 164/337 |
| 2,982,534 | 5/1961 | Meffert | 164/337 X |
| 3,187,394 | 6/1965 | Tama et al. | 164/337 X |
| 3,470,941 | 10/1969 | Thompson | 164/337 |
| 3,537,489 | 11/1970 | Hall | 164/323 X |
| 3,977,461 | 8/1976 | Pol et al. | 164/323 X |
| 4,557,313 | 12/1985 | Navarre | 164/337 X |
| 5,056,584 | 10/1991 | Seaton | 164/323 X |

*Primary Examiner*—J. Reed Batten, Jr.
*Attorney, Agent, or Firm*—Lawrence B. Plant

[57] ABSTRACT

The machine includes a train of molds moving through an arcuate pouring zone, a supply vessel for the metal, a trough extending between the vessel and the mold trains to convey the metal therebetween. The metal is discharged from beneath the surface of the metal in the vessel and into one end of the trough beneath the surface of the metal therein. The other end of the trough is registered with a mold in the trains and moves with the trains while metal is dispensed into the mold from beneath the surface of the metal in the trough. Valves control the discharging and dispensing of the metal to and from the trough. A motor moves the trough, as needed, in the pouring cycle, and a coupler coordinates the movement of the trough and the mold to keep them registered in the pouring zone.

13 Claims, 3 Drawing Sheets

QUIESCENT-FLOW METAL POURER

This invention relates to apparatus for pouring molten metal (particularly aluminum) from a stationary supply vessel into a series of sand molds moving successively through a pouring zone. A rotatable tundish conveys the molten metal from the stationary vessel to moving molds while tracking the molds through the pouring zone.

BACKGROUND OF THE INVENTION

Gravity pouring molten metal into green sand or loose sand (e.g., the lost foam process) molds is a known technique for economically making metal castings. Highly sophisticated equipment for continuously pouring such molds is in commercial use. One such piece of equipment for casting molten iron is disclosed in Pol et al U.S. Pat. No. 3,977,461 which issued Aug. 31, 1976 and is assigned to the assignee of the present invention. Pol et al pours molten metal from a holding vessel into a series of sand molds moving through a pouring zone via a plurality of circulating ladles which lock onto and track the molds through the pouring zone. Each ladle holds sufficient iron to pour a single mold. More specifically, a plurality of pouring ladles are each mounted on a separate, independently driven and controlled carriage which moves unidirectionally on a track in a closed loop between: (1) a ladle-filling station beneath the holding vessel; (2) a pouring station where the ladle locks onto, tracks and pours an associated mold as the ladle and mold move together through the pouring station; and (3) then back to the filling station. Each ladle carriage is controlled by its interaction with preceding and succeeding carriages in the system. In the pouring zone, the ladle carriage is mechanically coupled to a mold to be poured to maintain the ladle's pouring spout in registry with the pouring basin of the moving mold. Once coupled, the mold line drags the ladle through the pouring zone. After emptying its contents, the mechanical coupling device is disengaged, and the ladle then driven under its own power back to the filling station for refilling and repeat of the cycle. In each case, the molten iron falls through air from the holding vessel into the ladle, splashes as it enters the ladle, is thereafter agitated as the ladle moves from the filling station to the pouring zone and finally falls through air from the ladle into the mold.

While such equipment is suitable for pouring iron, it is not suitable for pouring molten aluminum which is highly reactive with air (i.e. $O_2$, $H_2O$, $CO_2$, and CO) and susceptible to hydrogen pickup from the $H_2O$. Aluminum reacts with oxygen to form a surface film of $Al_2O_3$ which slows further oxidation. Such free-falling, splashing and agitation of the aluminum breaks this surface film and exposes unoxidized aluminum to the air which in turn causes entrapment of $Al_2O_3$ films in the aluminum and/or reaction with ambient gases and consequent formation of $Al_2O_3$, and dissolution of excessive amounts of hydrogen in the aluminum. Turbulence during the transfer of aluminum causes $Al_2O_3$ to pile up, forming dross which tends to stick to vessel walls and sporadically slough inclusions into the molten aluminum. The presence of $Al_2O_3$ and/or dissolved gas in the aluminum results in the formation of inclusions and gas bubbles in the casting. Moreover, the dissolved hydrogen tends to come out of solution and form hydrogen bubbles particularly easily in aluminum during the slow cooling thereof which is characteristic of sand casting processes. Both the gas bubbles and the inclusions are detrimental to the aluminum casting.

It is desirable for economic reasons to gravity cast substantially inclusion-free, gas-free aluminum into sand molds, and it would be desirable to devise an automatic pouring machine therefor which does not result in castings having gas bubbles or inclusions trapped therein.

Accordingly, it is the principal object of the present invention to provide a machine for automatically, gravity pouring any metal, and particularly for pouring substantially gas-free, inclusion-free aluminum, into a series of continuously moving sand molds. This and other objects and advantages of the present invention will become more readily apparent from the detailed description thereof which follows.

BRIEF DESCRIPTION OF THE INVENTION

The present invention contemplates a machine for pouring molten metals, particularly substantially gas-free, inclusion-free aluminum into a series of advancing sand molds via a tundish that moves in unison with the molds through a pouring zone which tundish is adapted to receive molten metal from a supply thereof in a substantially quiescent, non-oxidative manner. Pouring is effective from beneath the surface of the molten aluminum such that the protective oxide film formed thereon remains unbroken within the machine. The machine includes a train of interconnected carriages each carrying a mold as it travels from a starting position to a finishing position through a pouring zone having an arcuate path. A heated vessel remote from the mold train contains a supply of molten metal (e.g. degassed aluminum) to be poured into the molds. A cover atop the vessel substantially isolates the metal therein from the ambient atmosphere. A valved outlet is provided at the bottom of the vessel for discharging the molten metal from beneath the surface thereof in the vessel into an underlying rotatable tundish. The tundish comprises at least one (preferably more) trough(s) extending between the supply vessel and the mold train for conveying molten metal from the vessel to a particular mold in the train. A cover atop the trough substantially isolates the metal therein from the ambient air. A first distal end of the trough remote from the supply vessel includes a valved outlet for dispensing metal into a mold registered therewith as the mold and distal end move together through the arcuate pouring zone. A second end of the trough underlies the supply vessel, is adapted to convey molten metal from the supply vessel to the mold, and serve as a pivot for the trough so as to permit the distal end of the trough to move in unison with an associated mold through the pouring zone while concurrently dispensing molten metal therefrom into the mold. Valves associated with the trough and vessel outlets control the amount and rate of flow of the molten metal between the trough and the mold and the vessel and the trough respectively. A depending spout underlying the vessel's outlet permits metal flowing from the vessel to enter the trough beneath the level of molten metal therein, thereby eliminating free-falling through air, splashing of the metal and trapping of inclusion and gas therein as it enters the tundish/trough. It also maintains the surface films undisturbed and hence minimizes the amount of reaction with or hydrogen pickup from the air. The valve at the outlet of the pouring vessel will preferably comprise a "pin-and-spout" type valve well known in the aluminum industry. The valve at the distal end of the tundish/trough for controlling the dispensing of molten aluminum into the sand mold registered therewith will preferably comprise a "stopper-rod" type valve well known to the foundry industry. A motor drives the trough forward and backwards as needed to register it with the moving mold and to return it to the starting position of the pouring cycle. A coupler coordinates the movement of the distal end of the trough with that of the mold being poured so as to maintain the distal end of the trough registered with the mold as they move together through the pouring zone. The coupler will preferably be a mechanical link between the mold carriage and the distal end of the trough which permits the mold carriage to pull the distal end of the trough along with it through the pouring zone. At the end of the pouring zone, the link is disengaged and the motor returns the tundish to the starting position. Another method would be to drive the distal end of the trough at a nominally higher speed than the mold train, and, by appropriate linkage, have the mold train limit the forward motion of the trough. Alternatively, however, the coupler may comprise one or more sensor(s), e.g., mechanical, photo electric, magnetic, etc., which signal when the distal end of the trough is registered with the mold to be poured and keeps it so registered. One method is to match the speed of the trough's driving motor to the speed of the moving mold line and thereby coordinate movement of the trough and the mold being poured without actually mechanically linking them together.

Preferably the machine will include a tundish having a plurality of angularly spaced branches or more specifically a plurality of troughs extending radially from a common hub between the supply vessel and the mold train. Molten metal is discharged from the supply vessel into the hub area of the tundish and from there distributed via the several troughs to a plurality of molds registered with the distal ends of the troughs remote from the hub.

Preferably: (1) the trough and the supply vessel will be flooded with a blanket of an inert gas (e.g., nitrogen) to reduce thickening of surface films, the formation of dross and hydrogen pickup incident to exposure of molten aluminum to humid ambient air; (2) the supply vessel and trough(s) are heated to maintain the temperature of the molten metal therein; and (3) the trough(s) will rotate about an axis of rotation which is coaxial with the axis of the spout used to discharge molten metal from the supply vessel into the rotating tundish/-trough so as to eliminate any turbulence in the zone of the tundish where the molten aluminum enters it.

Most preferably, the tundish will comprise a plurality of troughs extending radially from a common hub which serves as the metal receiving end of each of the troughs. The several troughs concurrently pour a plurality of successive molds in the train and accordingly increase the throughput of the machine.

Operationally, the mold train moves continuously (i.e., nonstop) while the tundish/trough preferably pivots to and fro between the starting and finishing points of the pouring zone. In this regard and in connection with the preferred embodiment, when the trough locks onto the mold carriage, its drive motor is disengaged and it will move continuously with the mold carrier through the arcuate pouring zone from the starting position to the finishing position under the power of the mold train. Once the distal end of the trough reaches the finishing position of the pouring zone and the mold has been poured, it disengages from the mold carriage, has its drive motor engaged and returns, under its own power, to the starting position for re-registering with a subsequent mold. This will require the trough to reverse direction and quickly return to the starting position, and thereat reverse direction again and accelerate up to the speed of the mold line until its dispensing outlet is in registry with the pouring basin of the mold at which time coupling of the trough with the mold carriage occurs and pouring begins. Alternatively, the tundish could travel in a full circle back to the starting position without having to reverse direction, but this would require additional floor space and accordingly is less desirable than the preferred embodiment. As indicated above and in accordance with the most preferred embodiment, coupling is achieved by mechanically linking the trough to the mold and concurrently disengaging the trough's drive motor so that the mold pulls the trough along with it. At the end of the pouring zone, the link is disengaged and the trough's drive motor energized to return the trough to the starting position.

BRIEF DESCRIPTION OF THE DRAWING

The invention will be better understood when considered in the light of the following detailed description of a particular preferred embodiment thereof for pouring aluminum, which is given hereafter in conjunction with the several figures in which.

DETAILED DESCRIPTION OF A SPECIFIC EMBODIMENT

Figure 1:
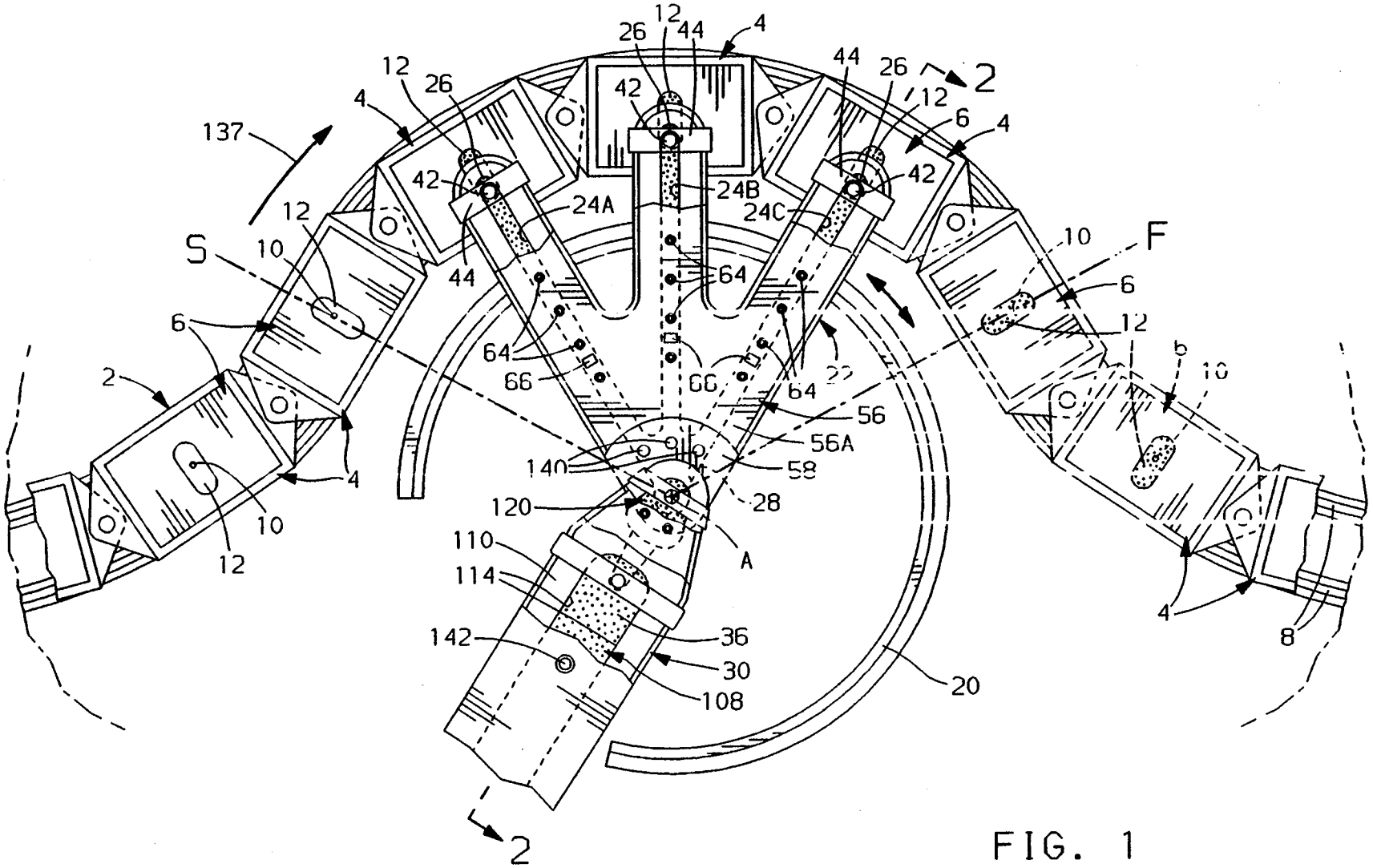
FIG. 1 is a plan view of a continuous aluminum pouring machine in accordance with the present invention.

The figures illustrate a train 2 of mold carriages 4 each carrying a mold 6 thereon continuously moving in a clockwise direction along a track 8. Each mold 6 is formed of a green sand cope portion 6A and a green sand drag portion 6B, and has a sprue 10 at the bottom of a pouring basin 12 for directing molten aluminum into a runner system 14 servicing a mold cavity 16. The molds 6 are poured as they traverse the arcuate path of the pouring zone which commences at starting position S and ends at the finishing position F. The arcuate pouring zone S and F forms a segment of a circle having its center of rotation on the central axis A of the pin and spout valve 18. A second track 20, concentric with the tracking in the arcuate pouring zone S–F serves to guide and support a tundish 22 which rotates about the axis A.

The tundish 22 comprises at least one trough 24 (preferably two or more 24A, 24B, 24C, etc.) having a distal first end 26 remote from a second end 28 about which the tundish 22 pivots. The trough(s) 24 extend(s) between a molten aluminum supply vessel 30 and the molds 6 as they traverse the arcuate pouring zone S–F. The distal end(s) 26 of the trough(s) 24 includes an outlet 38 flow-through which is controlled by a stopper-rod type valve 32 and mating valve seat 34. The second, or pivotal, end 28 of the trough 24 underlies an outlet 40 from the aluminum supply vessel 30, and is adapted to receive molten aluminum 36 therefrom. When multiple troughs 24 are involved, each (i.e., 24A, 24B, 24C) will share a common second end 28 which serves as the hub for the multiple troughs. The hub 28 has its center on the axis A of the stopper rod valve 18 such that upon rotation of the trough(s) 24 thereabout the distal end(s) 26 of trough(s) 24 will always remain in precise registry with the molds 6 being poured, and any turbulence of the aluminum at the hub 28 that might otherwise occur if the hub were off center from the spout 104 is eliminated. During pouring of the mold 6 the stopper-rod valve 32 is raised by an electric motor actuator or a pneumatic or hydraulic cylinder 42 which is carried by a support bracket 44 which is attached on both ends to the trough 24 so as to raise the cylinder 42 above the trough 24 and away from the heat of the metal.

The tundish 22 comprises an outer metal shell 46, containing an inner lining of refractory material 50. The tundish 22 is enclosed by a cover 56, and a lid 58 so as to prevent exposure of the molten aluminum 36 to the air. Preferably, the region 60 above the molten aluminum 36 will be filled with an inert gas (e.g., nitrogen) to essentially preclude any reaction between the aluminum and air. Hose fittings 140 are provided in the lid 58 adjacent the hub 28 for introducing the inert gas to the tundish. The cover 56 is divided into two parts 56A and 56B having an opening 62 therebetween which permits removal of the cover 56 without removing the valve 32 and consequent draining of the molten aluminum 36 from the tundish 22. A plurality of electric immersion heaters 64 are carried by the cover 56 and serve to maintain the molten aluminum 36 at the desired temperature. Other types of heaters such as overhead radiant heaters, may be substituted for the immersion heaters. Thermocouples (not shown) provide input to controllers for the heaters to maintain the melt temperature at the desired level. A liquid level sensor 66 affixed to the cover 56 senses and maintains the level of the molten aluminum 36 in the trough 24 at a prescribed minimum level sufficiently high as to insure that metal flowing into the hub 28 from the vessel 30 will always enter the tundish 22 beneath the surface 144 of the molten aluminum in the trough(s). In this regard, a signal generated by the sensor 66 serves to control the opening and closing of the valve 18 for discharging additional molten aluminum 36 into the hub 28 of the troughs 24 as molten aluminum is dispensed therefrom into mold 6 through the valved outlet 38. The second lid 58 is provided to isolate the end of the tundish that underlies the supply vessel 30 (i.e., the hub 28 for a multi-trough tundish) from the ambient air while still permitting separate removal of the cover 56 for service as may be required. An overflow outlet 68 is provided to permit any excess aluminum to overflow from the tundish 22 into a sandbox collector 70. The overflow 68 may also be used to route dross floating atop the molten metal into the sandbox 70 when the surface of the metal in the trough is spent. Similarly, a valved drain 72 is provided to permit draining of the trough 24 into the sandbox 70 should the need arise so to do.

The tundish 22 is carried by a carriage 74 which rotates about a spindle 76 which, in turn, is coaxial (i.e., coincident with axis A) with the stopper rod valve 18. A wheel 78 supports the free end of the carriage 74 on the rail 20, and is driven by a motor 80 via a gear set 82 connected to the motor 80 by shaft 84. A clutch mechanism 86 between the gear set 82 and the wheel 78 serves to couple and uncouple the wheel 78 from the motor 80 as needed. The motor 80 may be a pneumatic (preferred), hydraulic, or electric motor or simply a two-way hydraulic or pneumatic cylinder, or the like, attached on its one end to the carriage 74 and on its other end to an appropriate anchoring site (not shown). Any other type of motor would also be acceptable. A pneumatic or hydraulic cylinder 88 is affixed to the housing 90 for the gear set 82, and serves to extend and retract a pin 92 into and out of engagement with a recess 94 in the mold carriage 4 so as to mechanically link the mold carriage 4 with the trough carriage 74 when the outlet 38 of the trough 24 is registered with the pouring basin 12 of the mold 6. When the pin 92 is extended into engagement with the recess 94, a switch (not shown) is energized which disengages the clutch 86 to disconnect the gear set 82 from the wheel 78 so that the tundish carriage 74 can travel unimpeded along with the mold carriage 4 under the power of the mold carriage 4.

A strengthening flange 96 underlies the length of the tundish 22, and is pivotally connected to a pin 99 in a rigid upright support 98 near the distal end 26 of the trough 24. A rod 100 of an hydraulic jack 102 located near the other end 28 of the trough 24 is likewise pinned to the flange 96. The hydraulic jack 102 can be energized to cause the second or hub end 28 of the tundish 22 to lower (i.e., the tundish 22 tips by pivoting about the pin 99). This tipping of the tundish 22 permits molten metal to drain therefrom into the sand bed 70 as well as provides ready access (e.g. for servicing) to the spout 104 depending from the outlet 40 of the supply vessel 30.

The supply vessel 30 comprises an outer metal shell 106, containing an inner lining of refractory material 110 like that used in the tundish 22. One portion of the inner refractory material 110 provides a floor 112 and sidewall 114 defining a relatively large reservoir chamber 108 for holding the molten aluminum 36. Another portion of the refractory material 110 provides a floor 116 and wall 118 defining a dispensing chamber 120 from whence the molten metal 36 flows into the tundish 22 via the outlet 40 and refractory spout 104. A refractory tube 105 surrounds the spout 104 and the annular region 107 therebetween is filled with nitrogen to keep any air from being drawn into the spout 104 through any porosity in the walls thereof. The nitrogen exits the region 107 via the port 109. A refractory partition 122 separates the reservoir chamber 108 from the dispensing chamber 120. A stopper-rod type safety valve 124 and mating seat 126 provide a passageway 128 between the reservoir 108 and dispensing 120 chambers for permitting flow of molten aluminum therebetween under normal operating conditions, and the capability of isolating the chambers from each other if the need arises. Alternatively, the safety valve 124 and passageway 128 could be eliminated and the two chambers communicated by means of a pump, or siphon straddling the partition 122, for moving aluminum from the reservoir chamber 108 into the dispensing chamber 120. Shutting off the pump or breaking the siphon discontinues flow between the chambers. An immersion heater 130 is provided in the dispensing chamber 120 to control the temperature of the molten aluminum 36 therein. Additional such heaters (not shown) are also provided in the reservoir chamber 108. A multi-part cover 132 covers the supply vessel 30, and protects the molten metal therein from contact with the ambient air. Preferably, the region 134 between the cover 132 and the surface of the metal 36 will be filled with inert gas (e.g., nitrogen) to further isolate the molten aluminum from reaction with the air. A fitting 142 is provided in the cover 132 for admitting the inert gas to the supply vessel 30.

In operation, the level sensor 66 serves to control the opening and closing of the valve 18 so as to keep the level of the molten aluminum surface 144 in the tundish 22 at all times at prescribed minimum level which is above the exit end 136 of the spout 104 and below a prescribed maximum level which is beneath the entrance to the overflow 68. This precludes aluminum from splashing into the tundish 22, and from breaking the oxide layer on the surface 144 of the aluminum in the tundish which oxide layer protects the underlying aluminum, and which, if disrupted, can entrain oxide inclusions in the molten aluminum.

In operating the apparatus described above, the tundish 22 is initially positioned such that a left-hand branch 24A (see FIG. 1) of the several troughs 24 lies along the starting position S and the pin 92 (see FIG. 2) is extended into engagement with the recess 94 in the mold carriage 4. The other branches 24B, 24C of the tundish 22 are similarly aligned with molds to be poured, and may also be linked to the mold carriages for such molds. As the process begins, the mold train 2 is already moving in the direction indicated by the arrow 137, the "air gap" between the tundish 22 and the mold 6 is flooded with nitrogen, and the valve 32 is opened to permit molten aluminum to be dispensed into the filling basin 12 of the mold 6 via the outlet 38 at the distal end of the trough 24A. The same occurs simultaneously with the other branches 24B and 24C of the tundish 22. As the train moves through the arcuate pouring zone S–F, the molten aluminum continues to flow from the tundish 22 into the several molds 6. As the level of the molten aluminum in the tundish 22 drops, the level sensor 66 triggers the opening of the valve 18 to admit more molten aluminum into the tundish 22. Alternatively, the valve 18 may be kept open, not just during pouring, but also while the tundish is returning to the starting position as well. When operating the machine according to this alternative mode, the level of the metal in the tundish 22 will rise to its highest level during the return trip of the tundish 22 and start falling when pouring of the molds 6 begins. Regardless of which operating mode is chosen, the minimum surface level of metal in the tundish 22 will be such as to insure that the lower end 136 of the spout 104 is beneath the surface of the metal in the tundish 22 at all times. The valve 124 will remain open throughout pouring, but may be closed at any time should a need arise (e.g. failure of the valve 18). Pouring continues until the molds are filled or until the right-hand most branch 24C (see FIG. 1) of the tundish 22 reaches the finish position F, at which time pouring will cease and the dispensing valve(s) 32 close. For small mold cavities, pouring may cease and the valves 32 close before the right-hand most branch reaches the finish position F. The systems controls will determine when the molds are filled (e.g., by timer or level detector 138) and close the valves 32 which operate independently of each other. When the right-hand most branch 24C reaches the finish position F, a sensor (not shown) triggers retraction of the pin 92 from the recess 94 and energizes the motor 80 to drive the carriage 74 and tundish 22 counterclockwise back to the starting line S. The mold train 2 continues to move forward in the clockwise direction as the tundish 22 moves backwards. When the left most branch 24A of the tundish 22 reaches the starting position S, a sensor (not shown) triggers the motor 80 to reverse direction and accelerate the tundish 22 in the clockwise direction up to the speed of the moving train 2 and so as to bring the pin 92 into alignment with the recess 94. When the pin 92 and recess 94 are aligned (and hence the outlet 38 registered with mold basin 12), a sensor (not shown) causes the cylinder 88 to extend the pin 92 into engagement with the recess 94 which, in turn, energizes the disengagement of the clutch 86 as discussed above.

Figure 2:
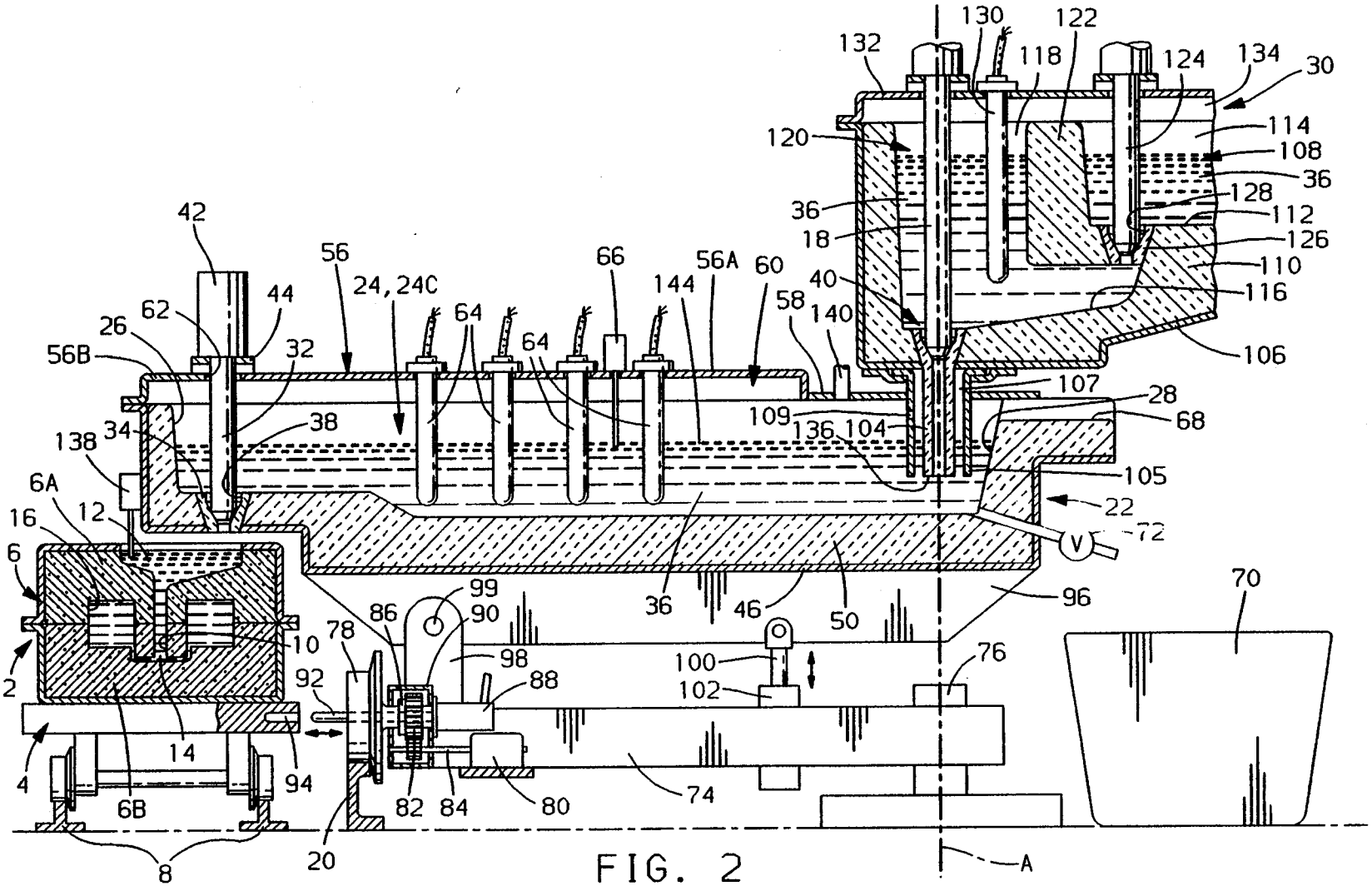
FIG. 2 is a view in the direction 2—2 of FIG. 1.
Figure 3:
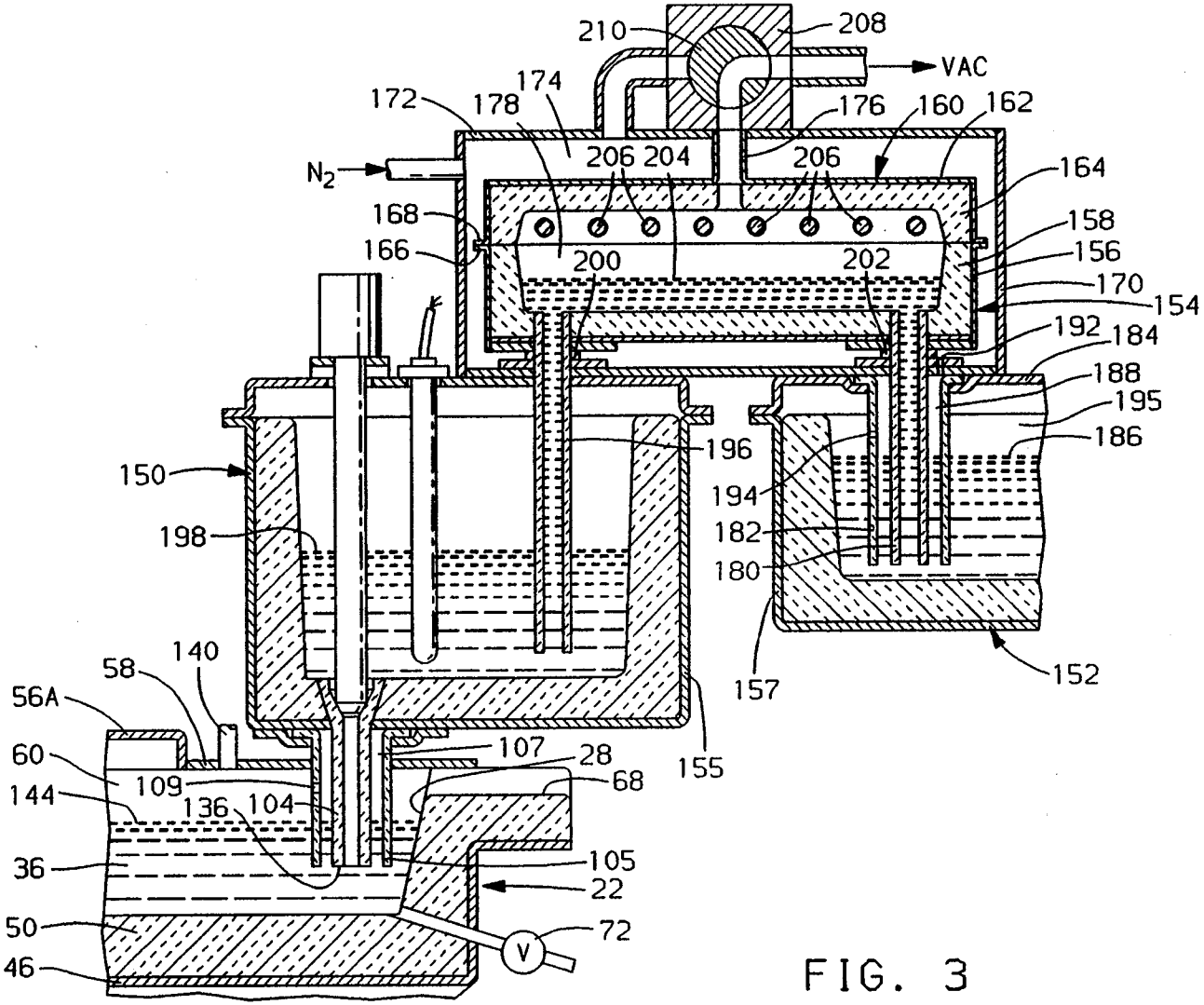
FIG. 3 is a partially sectioned side view of another embodiment of the present invention.

FIG. 3 illustrates a preferred embodiment of the machine of the present invention wherein the dual chamber supply vessel shown in FIG. 2 is replaced by two separate vessels in flow communication one with the other via a gas-shielded siphonic valve which replaces the stopper rod valve of FIG. 2. More specifically, the vessel 150 which supplies the tundish 22 is separated from its source 152 of molten metal (e.g., furnace, launder, etc.) so that the supply vessel 150 can be readily removed and serviced without having to empty, or otherwise disturb, the main body of molten metal. The tundish supply vessel 150 is in flow communication with its source 152 of metal via a siphonic valve 154 which permits metal to flow readily between the source 152 and the vessel 150 when metal is needed, but which can be quickly and positively shut off to isolate the vessel 150 from the source 152 in the event there is a need to do so (e.g., failure of the discharge valve 18). With this alternative, there is no fear that a safety valve, such as shown in FIG. 2, might itself fail at an inopportune moment (e.g., when the discharge valve is failed) and dump the entire contents of the reservoir chamber 108. The preferred siphonic valve 154 for this application is disclosed in U.S. patent application Ser. No. 233,916 filed Apr. 28, 1994 and filed in the name of A. D. Vander Jagt, and assigned to the assignee of this invention, which device comprises an elongated siphon box 154 which straddles the walls 155 and 157 that separate the supply vessel 150 from the metal source 152, and includes a supply pipe 180 depending into the source vessel 152, and a discharge spout 196 depending into the supply vessel 150. The siphon box 154 comprises a steel shell 156 having a refractory lining 158 and is covered by a lid 160 having a steel shell 162 and refractory lining 164. Flanges 166 and 168 on the box 154 and lid 160 respectively facilitate bolting of the box and lid tightly together. The siphon box 154 is encased in an outer steel housing 170 having a cover 172 secured thereto to define a sealed region 174 intermediate the box 154 and housing 170 which is filled with inert gas (e.g., nitrogen). A pipe 176 extends through the cover 172 and the lid 160 into the chamber 178 in the siphon box 154 and connects to a source of vacuum (not shown) outside the housing 170. The refractory supply tube 180 depends from the siphon box 154 down through a refractory shield pipe 182 depending from a cover 184 for the source vessel 152. Both the supply tube 180 and its surrounding shield pipe 182 extend below the surface 186 of the molten metal in the source vessel 152 so that the supply tube 180 can draw uncontaminated metal from beneath such surface 186. The annular region 188 between the concentric tube 180 and pipe 182 and above the surface 190 of the metal therein is filled with inert gas which is provided from the region 174 via an aperture 192 in the bottom of the housing 170. A vent 194 in the pipe 182 permits the inert gas to escape into the space 195 above the metal in the source vessel 152. The refractory discharge spout 196 depends from the siphon box 154 to below the surface 198 of the metal in the supply vessel 150 for delivering metal to the supply vessel 150 below such surface 198 and thereby prevent contamination of the metal. Sealing gaskets 200 and 202 respectively seal the joints between the housing 170, the supply 180 and discharge 196 tubes, and the siphon box 154. Radiant heaters 206 extend across the chamber 178 for maintaining the temperature of the metal therein at a desired level. In operation, a low level, controlled vacuum is drawn on the chamber 178 via the pipe 176 which, in turn, draws molten metal up into the chamber 178 to a desired level 204. As the level of the metal in the supply vessel 150 drops (relative to the level in the source 152) incident to the outflow of metal therefrom into the tundish 22, metal will flow between the source vessel 152 and the supply vessel 150. This flow will cease automatically when the level of metal in the supply vessel 150 reaches the level in the source vessel 152. At any time that the operator wishes to stop flow between the source and supply vessels, the vacuum is released and nitrogen admitted into the pipe 176 to break the siphon. This is conveniently handled by means of a two-way valve 208 connected to the pipe 176. Rotation of the valve core 210 in one direction connects the pipe 176 to the vacuum source (shown in the Figure) and rotation in the other direction connects the pipe 176 to the nitrogen in the region 174 between the siphon box 154 and the housing 170.

In an alternative embodiment (not shown), a gas shielded siphon valve like that discussed above in connection with FIG. 3 may also be substituted for the pin and spout valve 18 shown in FIG. 2 for transferring metal from the dispensing chamber 30 to the tundish 22. When so doing, the discharge spout (i.e., 196 of FIG. 3) will be encased by a shield pipe like the pipe 180 is in FIG. 3 and the space between the spout and surrounding pipe filled with inert gas to prevent air from being drawn into the spout as the metal falls therethrough into the tundish 22.

While the invention has been disclosed primarily in terms of a specific embodiment thereof it is not intended to be limited thereto, but rather only to the extent set forth hereafter in the claims which follow.

The embodiments of the invention in which an exclusive property or privilege is claimed is defined as follows:

1. A machine for pouring molten metal into a series of advancing sand molds comprising:

a train of mold-carriages each carrying a mold while travelling through an arcuate pouring zone from a starting position to a finishing position;

a vessel for containing a supply of said metal, said vessel having a first outlet for discharging said metal from said vessel into a trough from beneath the surface of said metal in said vessel, and a valve associated with said first outlet for controlling said discharging;

at least one trough located between said vessel and said train for conveying said metal from said vessel to a said mold in said train while maintaining a prescribed level of said metal in said trough, said trough having a first end registered with such mold and moveable with such mold from said starting position to said finishing position and a second end adapted to receive said metal from said first outlet, said first end having a second outlet for dispensing said metal from beneath said level in said trough into said mold and a valve associated with said second outlet for controlling said dispensing;

a spout operatively associated with said first outlet for discharging said metal from said vessel into said second end of said trough beneath said level in said trough;

a motor operatively associated with said trough for returning said trough from said finishing position to said starting position after said mold has been poured; and a coupler coordinating the movement of said first end of said trough with said mold so as to maintain said first end registered with said mold as they move together through said zone.

2. A machine for pouring molten, substantially gas-free, inclusion-free aluminum into a series of advancing sand molds comprising:

a train of carriages each carrying a mold while travelling through an arcuate pouring zone from a starting position to a finishing position;

a vessel for containing a supply of said aluminum, said vessel having a cover, a first outlet for discharging said aluminum from beneath the surface of the aluminum in said vessel into a trough underlying said first outlet, and a valve associated with said first outlet for controlling said discharging;

at least one trough located between said vessel and said train for conveying said aluminum from said vessel to a said mold in said train while maintaining a prescribed level of molten aluminum in said trough, said trough having a first end registered with such mold and moveable with such mold from said starting position to said finishing position and a second end adapted to receive said aluminum from said first outlet and rotatively moveable beneath said first outlet so as to permit said first end to move with said mold, said first end having a second outlet for dispensing said aluminum from beneath said level in said trough into said mold, and a valve associated with said second outlet for controlling said dispensing;

a cover for said trough;

a spout depending from said first outlet for discharging said aluminum from said vessel into said second end of said trough, said spout having a discharge end extending into said trough beneath said level;

a motor operatively associated with said trough for returning said trough from said finishing position to said starting position after said mold has been poured; and a coupler coordinating the movement of said first end with said mold so as to maintain said first end registered with said mold as they move together in unison through said zone.

3. A machine as claimed in claim 1 wherein said trough is supported on a trough-carriage and said coupler comprises a mechanical link engageable with said mold carriage and said trough-carriage for joining said carriages while said mold is being poured, and disengageable therefrom after said mold has been poured.

4. A machine according to claim 3 wherein said mold-carriage pulls said trough-carriage through said pouring zone.

5. A machine according to claim 2 including an inlet for introducing inert gas into said vessel and said trough beneath said cover.

6. A machine according to claim 3 wherein said mold-carriage restrains the movement of said trough-carriage through said pouring zone.

7. A machine according to claim 1 wherein said trough rotates about an axis of rotation which is coaxial with the axis of said spout.

8. A machine according to claim 7 wherein said spout discharges metal into said trough while said first end travels said zone with said mold.

9. A machine according to claim 1 wherein said train moves continuously and after returning to the starting position, said motor causes said first end to accelerate from the starting position in the direction the train is moving until it catches up to, registers with, and couples to an empty mold in the train.

10. A machine according to claim 3 including a sensor associated with one of said carriages for sensing when said first end is registered with said mold and then activating said coupler.

11. A machine for pouring molten metal into a series of advancing sand molds comprising:

a train of mold-carriages each carrying a mold while travelling through an arcuate pouring zone from a starting position to a finishing position;

a vessel for containing a supply of said metal, said vessel having a first outlet for discharging said metal from said vessel into a rotatable tundish from beneath the surface of the metal in said vessel and a valve associated with said first outlet for controlling said discharging;

said tundish comprising a plurality of troughs located between said vessel and said train and extending radially from a common hub for conveying metal supplied to said hub from said vessel to a set of molds in said train while maintaining a prescribed level of molten metal in said troughs, said troughs each having a first end registered with a mold in said set and moveable with such mold from said starting position to said finishing position, said common hub being adapted to receive said metal from said outlet beneath said prescribed level, said first end having a second outlet for dispensing said metal from beneath said level into a mold registered therewith and a valve associated with said second outlet for controlling said dispensing;

a spout operatively associated with said first outlet for discharging said metal from said vessel into said hub beneath said level;

a motor operatively associated with said tundish for returning said tundish from said finishing position to said starting position after said set of molds has been poured; and a coupler coordinating the movement of said first ends of said troughs with said set of molds so as to maintain said first ends registered with the molds of said set as they move together through said zone.

12. A machine according to claim 11 for pouring molten aluminum including a cover on said trough(s) and said vessel for isolating the aluminum therein from the ambient air and an opening in said covers for said aluminum in inert gas.

13. A machine according to claim 11 wherein said spout depends from said first outlet.

* * * * *